US005139259A

United States Patent [19]

Yeakley

[11] Patent Number: 5,139,259

[45] Date of Patent: Aug. 18, 1992

[54] MARBLE GAME APPARATUS

[76] Inventor: James J. Yeakley, 376 E. Wilbur Rd. #202, Thousand Oaks, Calif. 91360

[21] Appl. No.: 745,143

[22] Filed: Aug. 15, 1991

[51] Int. Cl.[5] ..... A63F 7/00

[52] U.S. Cl. ..... 273/118 A; 273/118 R

[58] Field of Search ..... 273/118 R, 118 A, 119 R, 273/119 A, 123 R, 123 A

[56] References Cited

U.S. PATENT DOCUMENTS

| | | | |
|---|---|---|---|
| 2,506,867 | 5/1950 | Gillian, Jr. et al. | 273/123 R |
| 2,636,740 | 4/1953 | McNeal | 273/118 R |
| 3,203,699 | 9/1965 | Pearson, Jr. | 273/119 A |
| 3,448,982 | 6/1969 | Griggs | 273/118 A |
| 3,653,665 | 4/1972 | Wahlberg | 273/126 R X |
| 4,215,863 | 9/1980 | Kuiper | 273/126 R |
| 4,256,307 | 3/1981 | Brooks | 273/118 A |
| 4,549,737 | 10/1985 | Seyer et al. | 273/118 R |

*Primary Examiner*—Benjamin Layno
*Assistant Examiner*—Raleigh W. Chiu
*Attorney, Agent, or Firm*—Leon Gildin

[57] ABSTRACT

An apparatus includes a support table, including an outer wall spaced from an inner wall defining a trough therebetween for containing marbles projected from a central playing surface. The central playing surface includes an annular abutment wall arranged in surrounding relationship relative thereto to maintain marbles within the central playing surface. A modification of the invention includes a magnetic member rotatably mounted underlying the table and radially adjustable relative thereto to effect deflection of ferrous metallic marbles projected on the playing surface in cooperation with non-ferrous metallic marbles.

4 Claims, 4 Drawing Sheets

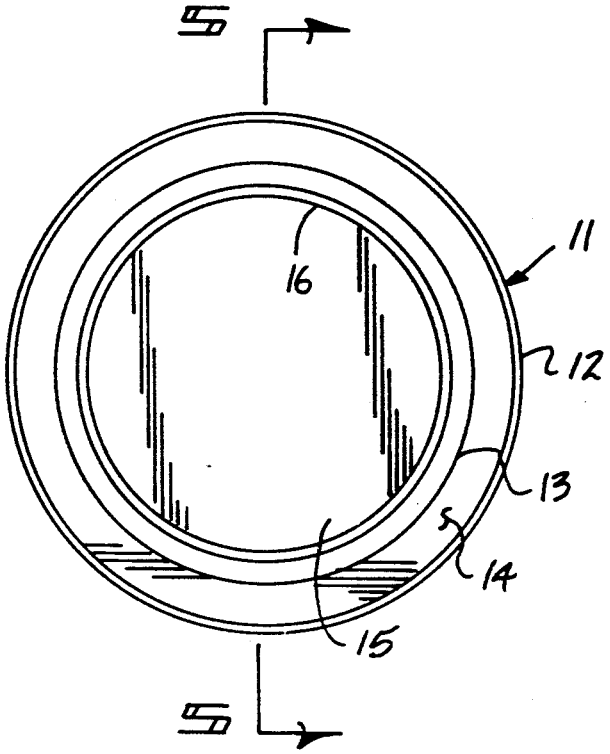
Fig 1
Fig 2
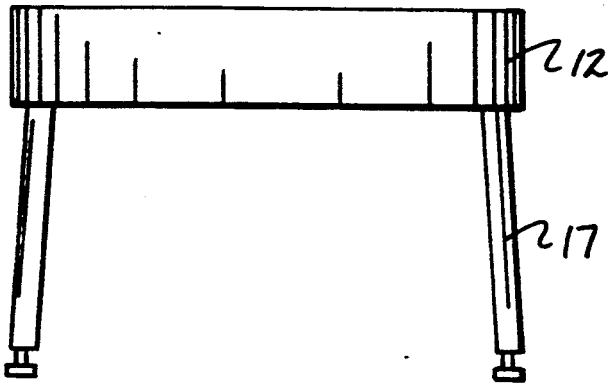

MARBLE GAME APPARATUS

BACKGROUND OF THE INVENTION

1. Field of the Invention

The field of invention relates to marble apparatus, and more particularly pertains to a new and improved marble game apparatus wherein the same is arranged to provide for a unique inter-play of spherical marbles upon a central support to contain the marbles in a confined forum.

2. Description of the Prior Art

Various games to include marbles and the like have been utilized in the prior art and exemplified for example in various environments such as in U.S. Pat. No. 4,790,535 to Droske, Jr. wherein a marble playing game utilizes various chutes directed therethrough.

U.S. Pat. No. 4,251,072 to Anthony sets forth a marble game apparatus similar in construction to a pool table.

U.S. Pat. No. 3,877,702 to Saliger sets forth a marble game table formed with peripheral pockets and cushions for effecting interplay of the marbles about a central top surface.

U.S. Pat. No. 4,445,689 to Rainey sets forth a marble playing support, including a plurality of border members around the periphery of the central mat extending upwardly from the central mat.

As such, it may be appreciated that there continues to be a need for a new and improved marble game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of marble game apparatus now present in the prior art, the present invention provides a marble game apparatus wherein the same provides a confined central support for the positioning and containment of marble games therewithin. As such, the general purpose of the present invention, which will be described subsequently in greater detail, is to provide a new and improved marble game apparatus which has all the advantages of the prior art marble game apparatus and none of the disadvantages.

To attain this, the present invention provides an apparatus including a support table, with an outer wall spaced from an inner wall defining a trough therebetween for containing marbles projected from a central playing surface. The central playing surface includes an annular abutment wall arranged in surrounding relationship relative thereto to maintain marbles within the central playing surface. A modification of the invention includes a magnetic member rotatably mounted underlying the table and radially adjustable relative thereto to effect deflection of ferrous metallic marbles projected on the playing surface in cooperation with non-ferrous metallic marbles.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved marble game apparatus which has all the advantages of the prior art marble game apparatus and none of the disadvantages.

It is another object of the present invention to provide a new and improved marble game apparatus which may be easily and efficiently manufactured and marketed.

It is a further object of the present invention to provide a new and improved marble game apparatus which is of a durable and reliable construction.

An even further object of the present invention is to provide a new and improved marble game apparatus which is susceptible of a low cost of manufacture with regard to both materials and labor, and which accordingly is then susceptible of low prices of sale to the consuming public, thereby making such marble game apparatus economically available to the buying public.

Still yet another object of the present invention is to provide a new and improved marble game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic top view of the instant invention.

FIG. 2 is an orthographic side view of the instant invention.

FIG. 5 is an orthographic view, taken along the lines 5—5 of FIG. 4 in the direction indicated by the arrows.

DESCRIPTION OF THE PREFERRED EMBODIMENT

Figure 3:
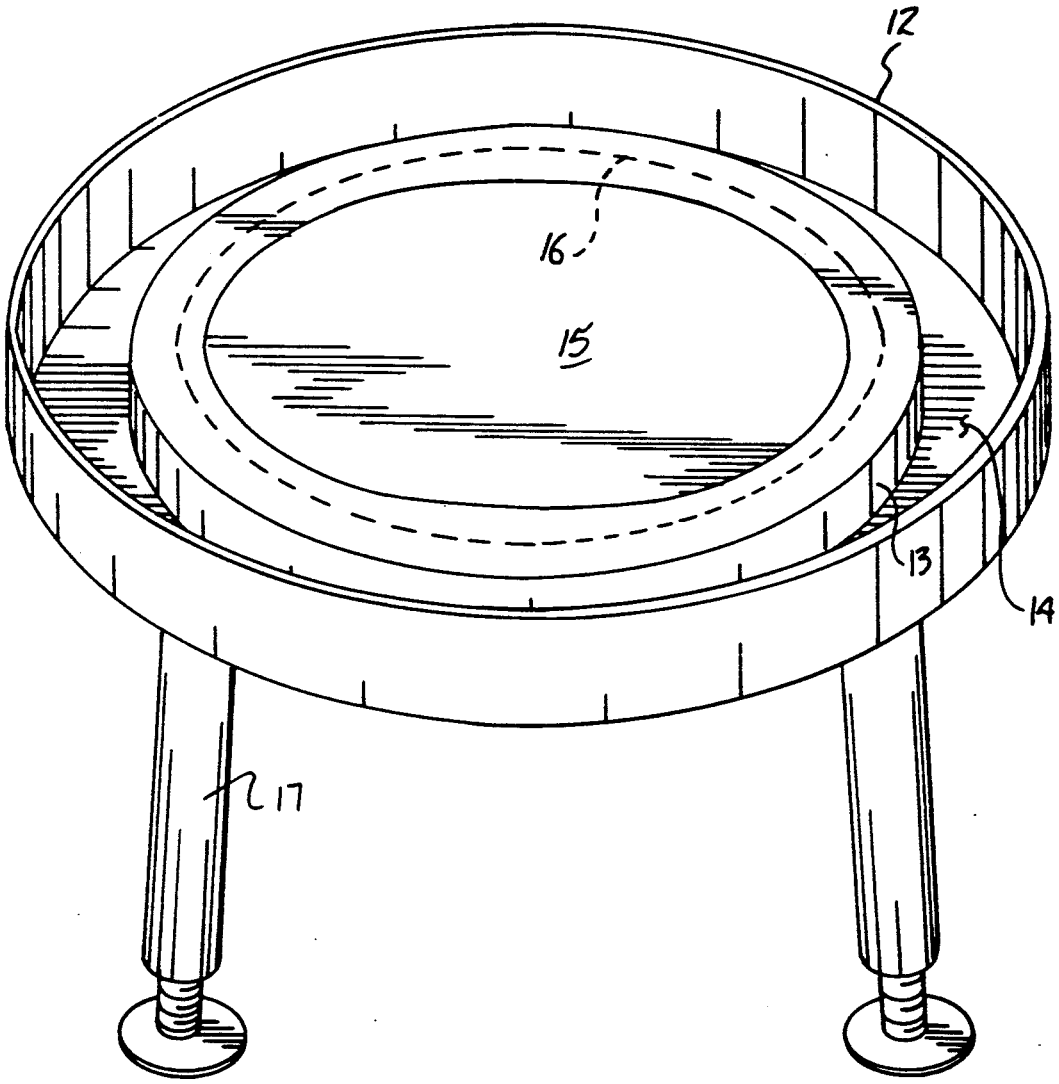
FIG. 3 is an isometric illustration of the support structure utilized by the invention.
Figure 3:
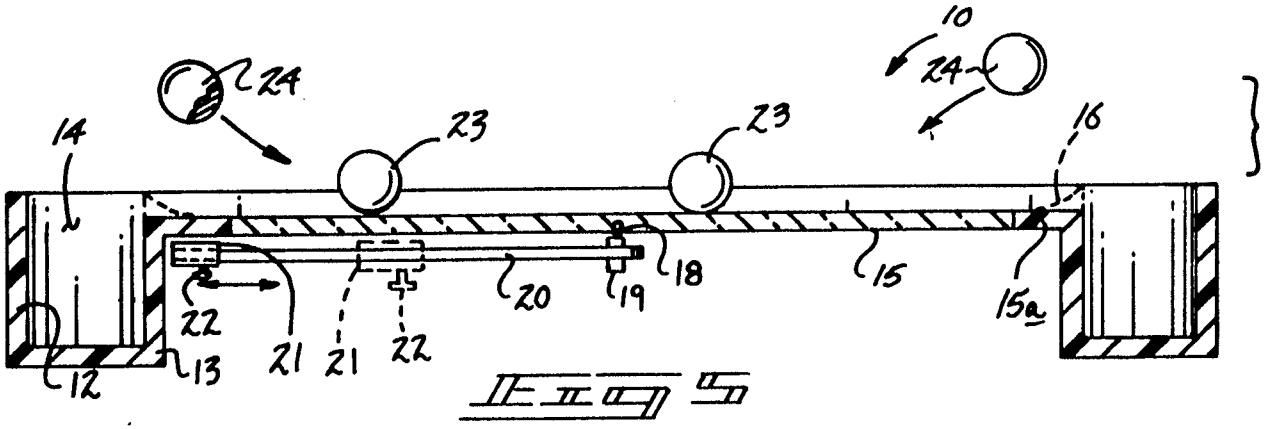
Figure 4:
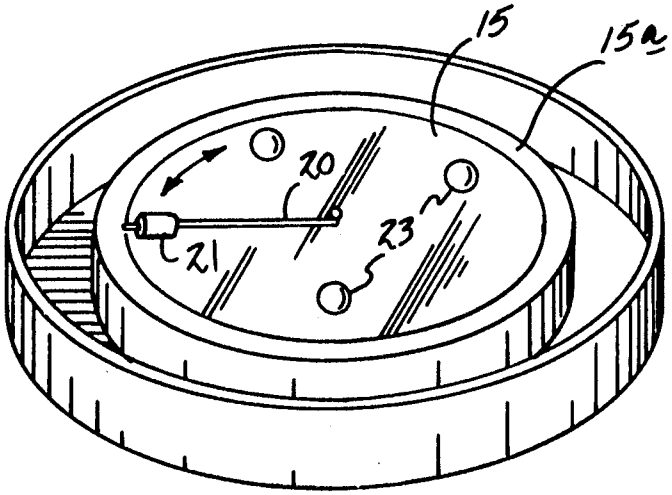
FIG. 4 is an isometric illustration of the marble game support table utilizing a transparent central support surface.

With reference now to the drawings, and in particular to FIGS. 1 to 6 thereof, a new and improved marble game apparatus embodying the principles and concepts of the present invention and generally designated by the reference numeral 10 will be described.

More specifically, the marble game apparatus 10 of the instant invention essentially comprises a table 11, including a cylindrical outer wall 12 defined by a first height, with a cylindrical inner wall 13 coaxially oriented within the outer wall 12 defined by a second height less than the first height. A trough 14 includes a floor formed at a lower terminal end of the outer and inner walls 12 and 13, and is positioned between the outer and inner walls 12 and 13. A cylindrical planar playing surface 15 extends orthogonally and coextensively interiorly of the inner wall 13 mounted within a torroidal opaque support flange 15*a* coplanar with 15. Typically, the playing surface 15 is transparent, as illustrated in FIG. 5.

The invention may further include an abutment wall 16 extending upwardly of the inner wall 13 to assist in maintaining the various spherical marbles within the playing surface defined between the abutment wall which is arranged to include an inclined surface directed interiorly of the playing surface to provide a ramp, whereupon marbles may ascend the ramp and be deposited within the trough 14 and out of play.

Various marble games may be played upon the playing surface 15 according to various rules as desired by the individual players. Typically, when a second marble member 24 is directed onto the playing surface 15 and strikes a first spherical marble member 23 and directs such marble member into the trough 14 subsequent to impact, that struck marble is declared the property of the moving player.

The table 11 may be further formed with support legs 17, including telescopingly arranged adjustable lower end 17 to provide for leveling of the playing surface 15 in use.

Further, a support axle 18 is coaxially and integrally mounted to a bottom surface of the playing surface and extends downwardly therefrom rotatably mounting a support block 19. The support block 19 orthogonally mounts a rotary rod 20 arranged parallel relative to the bottom surface of the playing surface 15, wherein the rotary rod 20 adjustably mounts a ferromagnetic cylinder 21 thereabout. The ferromagnetic cylinder includes a through-extending bore, with a lock rod 22 radially projecting through the cylinder into the central bore into selective communication with the rotary rod 20 to effectively lock the magnetic cylinder into a radial orientation relative to the lock rod 22. The magnetic cylindrical member is initially rotated with the rotary rod 22, wherein the first spherical marble members 23 are of a rigid non-ferrous material, while the second marble members 24 are of a ferrometallic material, whereupon rotation of the rod and the associated magnetic member 21 imparts deflection to the second marble members 24 as they are directed onto the playing surface to provide for enhanced difficulty in use of the organization.

Figure 6:
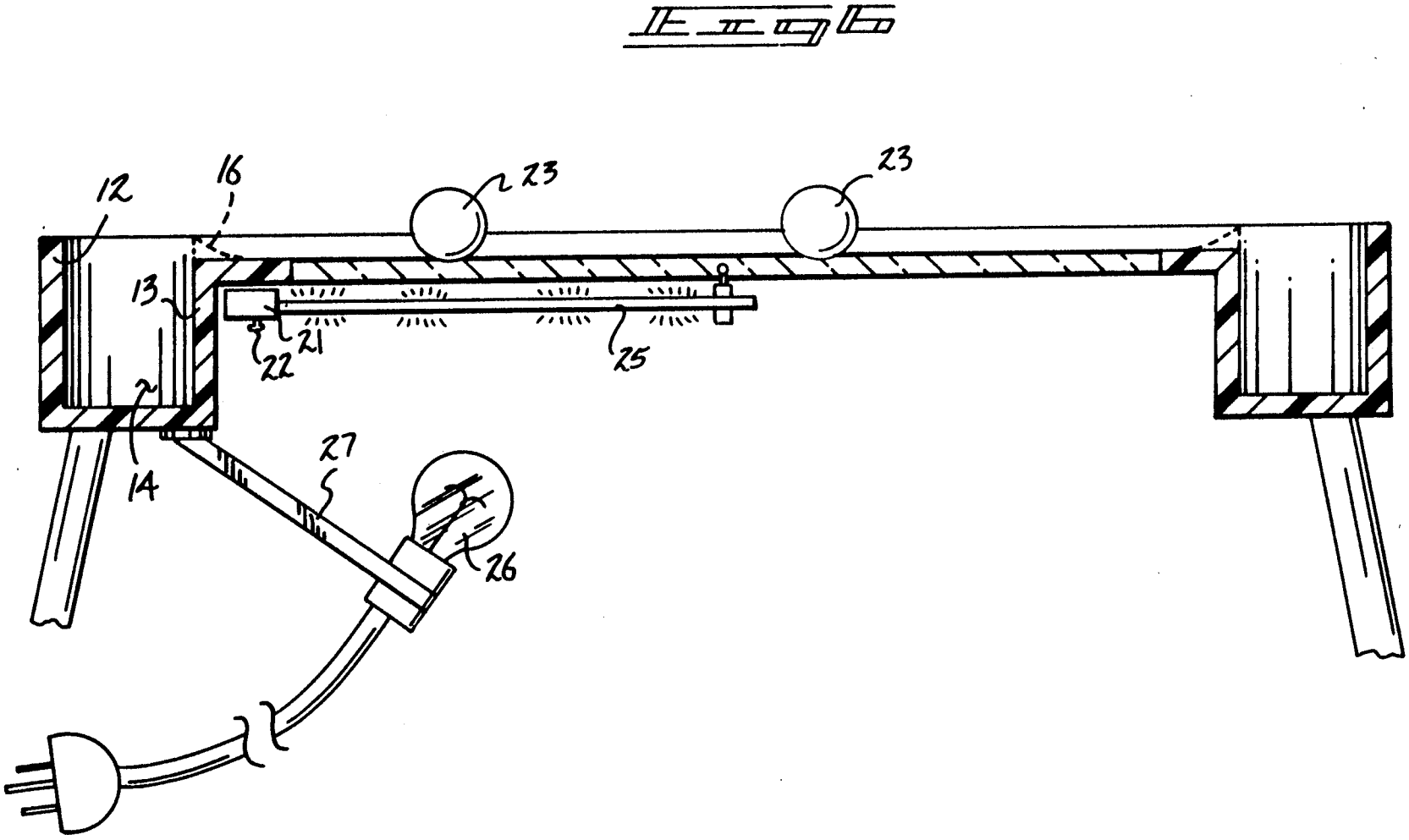
FIG. 6 is a further example of the support table in cooperation with the marbles in playing of the game of the invention.

Further, a modification of the invention, as illustrated in FIG. 6, includes the rotary rod 20 formed as a luminescent rod 25, with an illumination bulb 26 positioned therebelow to enhance illumination of the luminescent rod to provide visual indication and orientation of the rod and associated magnetic cylinder to permit a moving player to gauge the effect of the ferromagnetic cylinder 21 relative to its orientation to the playing surface 15 prior to the moving player projecting a second marble member 24 onto the playing surface. In this manner, a moving player may either utilize or attempt to avoid the magnetic effects of the cylinder 21 upon the ferrous metallic second marble member 24 when directed at the target first marble member 23.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A marble game apparatus, comprising, a table, the table including a cylindrical outer wall defined by a first height, with a cylindrical inner wall positioned coaxially and interiorly of the outer wall defined by a second height less than the first height, and a trough contained between the outer wall and the inner wall, including a trough floor orthogonally mounted at a lower terminal end of the outer wall and inner wall interconnecting the outer wall and the inner wall, and a circular planar playing surface extending within the inner wall orthogonally oriented relative to the inner wall, and an abutment wall extending upwardly from the inner wall above the playing surface, with the abutment wall including a sloped ramp surface in confronting relationship relative to the playing surface, and the table includes a plurality of legs mounted to the table, and each leg of a plurality of legs includes a telescopingly adjustable lower end portion, and a support axle integrally and orthogonally mounted to a bottom surface of the playing surface coaxially thereof, the playing surface formed of a transparent material and wherein the support axle includes a support block rotatably mounted about the support axle, the support block fixedly mounts a rotary rod, the rotary rod arranged parallel relative to the bottom surface of the playing surface, and the rotary rod including a ferromagnetic cylinder slidably and adjustably mounted along the rotary rod.

2. An apparatus as set forth in claim 1 including a plurality of spherical marbles, including a plurality of first marbles formed of a rigid non-ferrous material, and a plurality of second marbles, the second marbles formed of a rigid ferrous material, wherein rotation of the rotary rod and the ferromagnetic cylinder effects deflection of the second marble members when directed onto the playing surface.

3. An apparatus as set forth in claim 2 wherein the ferromagnetic cylinder includes a coaxially directed cylindrical bore, and the magnetic cylinder includes a lock rod radially directed into the magnetic cylinder for selectively securing the lock rod into engagement with the rotary rod to effect selective positioning of the magnetic cylinder along the rotary rod.

4. An apparatus as set forth in claim 3 wherein the rotary rod is luminescent, and an illumination bulb is mounted to the table below the playing surface to effect illumination and visual orientation of the rotary rod and associated ferromagnetic cylinder when rotated below the playing surface.

* * * * *